US008555835B2

(12) United States Patent
Pätzold et al.

(10) Patent No.: US 8,555,835 B2
(45) Date of Patent: Oct. 15, 2013

(54) SWITCHABLE FINGER LEVER

(75) Inventors: Holger Pätzold, Burgebrach (DE); Joachim Krause, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 404 days.

(21) Appl. No.: 13/043,841

(22) Filed: Mar. 9, 2011

(65) Prior Publication Data

US 2011/0220050 A1 Sep. 15, 2011

(30) Foreign Application Priority Data

Mar. 9, 2010 (DE) ..... 102010010733

(51) Int. Cl.
*F01L 1/18* (2006.01)

(52) U.S. Cl.
USPC ..... 123/90.16; 123/90.27; 123/90.39; 123/90.44

(58) Field of Classification Search
USPC ..... 123/90.16, 90.27, 90.39, 90.44
See application file for complete search history.

(56) References Cited

U.S. PATENT DOCUMENTS

| | | | | |
|---|---|---|---|---|
| 8,434,440 | B2 * | 5/2013 | Manther et al. | 123/90.39 |
| 2008/0149059 | A1 * | 6/2008 | Murphy et al. | 123/90.39 |
| 2009/0064954 | A1 * | 3/2009 | Manther | 123/90.44 |
| 2009/0217895 | A1 * | 9/2009 | Spath et al. | 123/90.16 |
| 2010/0139589 | A1 * | 6/2010 | Kim et al. | 123/90.16 |
| 2010/0300389 | A1 * | 12/2010 | Manther et al. | 123/90.39 |

* cited by examiner

*Primary Examiner* — Thomas Denion
*Assistant Examiner* — Jorge Leon, Jr.
(74) *Attorney, Agent, or Firm* — Volpe and Koenig, P.C.

(57) ABSTRACT

A switchable finger lever for a valve train of an internal combustion engine is provided, with the finger lever having an inner lever which cooperates at a valve-side end region with a gas exchange valve of the internal combustion engine and is connected at a support-side end region turned away from the valve-side end region pivotally to a support. Outer levers (1*a*, 1*b*) connected pivotally to the inner lever are arranged on both sides of the inner lever while being urged against the inner lever in a pivoting direction through a spring and being capable of being coupled to the inner lever through a coupling element. The outer levers (1*a*, 1*b*) are configured with an identical structure and each outer lever (1*a*, 1*b*) is configured symmetrically to the longitudinal lever axis (2).

4 Claims, 3 Drawing Sheets

SWITCHABLE FINGER LEVER

CROSS-REFERENCE TO RELATED APPLICATIONS

This application claims the benefit of German Patent Application No. 102010010733.6, filed Mar. 9, 2010 which is incorporated herein by reference as if fully set forth.

FIELD OF THE INVENTION

The invention concerns a switchable finger lever for a valve train of an internal combustion engine, said finger lever comprising an inner lever which cooperates at a valve-side end region with a gas exchange valve of the internal combustion engine and is connected at an end region turned away from the valve-side end region pivotally to a support, outer levers connected pivotally to the inner lever being arranged on both sides of the inner lever while being urged against the inner lever in pivoting direction through a spring means and being capable of being coupled to the inner lever through a coupling element.

BACKGROUND

A finger lever of the pre-cited type is described in a not yet published patent application of the present applicant filed under the reference U.S. 61/217,539. This document shows a switchable finger lever for a valve train of an internal combustion engine comprising an inner lever which is flanked by two outer arms that are pivotal relative to the inner lever and are articulated on the sides of one end. A drawback of this configuration is that the two outer arms on the two sides of the inner lever are configured as two different components whose manufacturing necessitates different blanks that have to be processed with different tools. In addition, the differing outer arms have to be differently mounted. This results in high costs of manufacturing and assembly.

SUMMARY OF THE INVENTION

The object of the invention is therefore to simplify a switchable finger lever of the pre-cited type with regard to its structure and to reduce the costs of manufacturing and assembly. The invention achieves this objective.

The invention provides that the outer levers are configured with an identical structure and each outer lever symmetrically to its own longitudinal lever axis. As identically structured components, the outer levers can be manufactured with the same tools and, due to their symmetric configuration they can both be mounted on both sides of the inner lever in the same manner. This considerably simplifies the handling of the outer levers during manufacturing and assembly and reduces the costs and complexity of manufacturing and assembly.

For fixing on the inner lever, each of the outer levers preferably comprises on the valve-side end region, two parallel spaced-apart tabs configured symmetrically to the longitudinal lever axis. These tabs preferably comprise aligned through-openings extending crosswise to the longitudinal lever axis, in which through-openings across- axle connection to the inner lever is received through which the outer levers and the inner lever are pivotally connected to each other. For this purpose, a cross-axle can extend, for instance, through the valve-side end region of the inner lever and be received in the through-openings of the outer levers. Alternatively, laterally protruding axle stubs may be configured on the valve-side end region of the inner lever and be received in the through-openings of the outer lever.

If a roller contact is made on the inner lever through a cam roller cooperating with the camshaft while being mounted for rotation on the inner lever through a pin arranged crosswise to the longitudinal lever axis, it is advantageous to provide on the longitudinal sides of the outer levers, contact sections configured symmetrically to the longitudinal lever axis and serving for a contact of the pin. These contact sections on the longitudinal sides of the outer levers facing the inner lever are situated frontally and pivotally opposite respective ends of the pin.

Preferably, two parallel spaced-apart tabs configured symmetrically to the longitudinal lever axis are arranged on the outer levers on a support-side end region of the outer levers on an underside turned away from the cam. Preferably, these tabs form a pocket-shaped depression which is open on the underside and towards the front end while being configured symmetrically to the longitudinal lever axis, and a leg of at least one torsion leg spring connected to the inner lever engages positively into each depression.

In a further preferred embodiment of the invention, the outer levers comprise on their upper sides facing the cams, cam-contacting surfaces cooperating with the cams, and the upper sides comprise a lateral overhang on the longitudinal sides, and said overhang extends crosswise to the longitudinal lever axis of the respective outer lever and is configured symmetrically to the longitudinal lever axis.

BRIEF DESCRIPTION OF THE DRAWINGS

Further features of the invention result from the following description and the appended drawings in which one exemplary of embodiment of the invention is shown in simplified illustrations.

DETAILED DESCRIPTION OF THE PREFERRED EMBODIMENT

Figure 1:
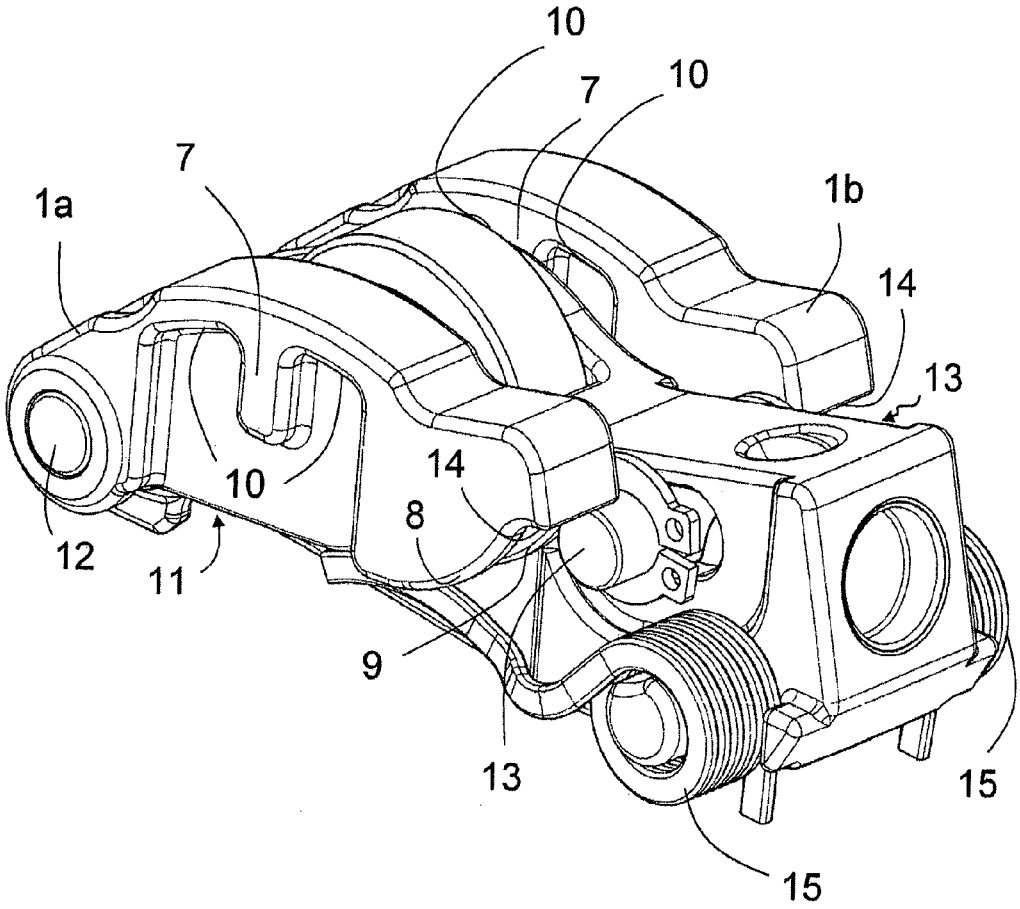
FIG. 1 shows a perspective illustration of a switchable finger lever according to the invention.

FIG. 1 shows an illustration of an exemplary embodiment of a switchable finger lever according to the invention for a valve train of an internal combustion engine. The finger lever comprises an internally arranged inner lever that is flanked by two outer levers 1*a*, 1*b*. The inner lever and the outer levers 1*a*, 1*b* cooperate through their upper sides with cams, not illustrated, of a camshaft of the internal combustion engine. On its underside turned away from the cams, the inner lever cooperates at its valve-side end region on a valve support 11 with a gas exchange valve (not illustrated) of the internal combustion engine. The inner lever and the outer levers 1*a*, 1*b* are arranged with their longitudinal lever axes 2 parallel to each other and are traversed at their valve-side end regions by a cross-axle 12 through which the outer levers 1*a*, 1*b* are articulated to the inner lever for relative pivoting. At its support-side end turned away from the valve-side, the inner lever is pivotally supported through its underside on a support element, not illustrated.

A cam-contacting surface configured as a sliding surface is arranged on an upper side of each outer lever 1*a*, 1*b*. A contact of the high lift cams takes place on these sliding surfaces. In the region of the sliding surfaces, the outer levers 1*a*, 1*b* are widened on their upper sides through a slightly protruding overhang 10 on each side.

For a roller contact with a low lift cam of the camshaft, the inner lever comprises, level with the sliding surfaces of the outer levers 1*a*, 1*b*, a cam roller mounted through a pin for rotation between two parallel legs and protruding slightly over the upper side of the inner lever. Opposite the front ends of the pin, a lug-shaped projecting contact section 7 extending in direction of the underside is configured on each of the longitudinal sides of the outer levers 1*a*, 1*b*. Each of the contact sections 7 forms on the longitudinal sides of the outer levers 1*a*, 1*b* facing the inner lever, a contact for the front ends of the pin which, during a pivoting of the outer levers 1*a*, 1*b* and the inner lever, are guided on the contact surfaces 7.

On the support-side end region of the inner lever are arranged coupling elements which comprise a locking pin 13. Through the locking pin 13 which protrudes beyond the outer sides of the inner lever and is arranged for longitudinal displacement in an oblong hole, the inner lever can be coupled to the outer levers 1*a*, 1*b*. For this purpose, each outer lever 1*a*, 1*b* comprises on the underside of its support-side end region, a support 14 that extends crosswise to the longitudinal lever axis 2 over the width of the lever while being matched to the locking pin 13.

On both sides of the support-side end region of the inner lever are arranged cross-axle stubs protruding in cross-axle direction. On each cross-axle stub is arranged with its coil assembly 15, a torsion leg spring forming a resetting spring means as an idle stroke spring. The inner leg of each of the torsion leg springs bears against a stop on the inner lever. The outer leg of each torsion leg spring bears against the underside of the support-side end region of the outer levers 1*a*, 1*b*.

Figure 2:
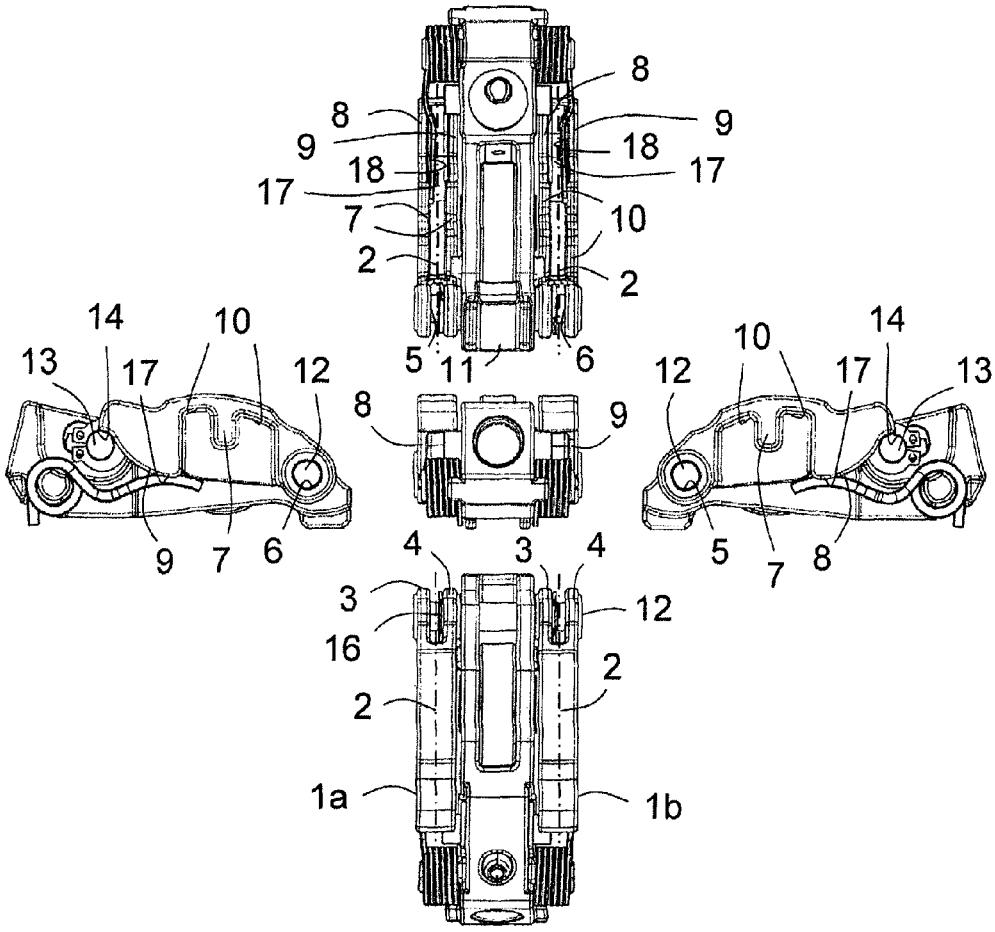
FIG. 2 is a compilation of a plurality of views of the switchable finger lever.

FIG. 2 shows a compilation of a plurality of views of the switchable finger lever. The central, middle illustration shows the support-side view of the finger lever. The illustrations above and below this, show respectively, a view of the underside of the finger lever turned away from the cams and a view of the upper side of the finger lever facing the cams. Each of the left hand-side illustration and the right hand-side illustration shows a view of the longitudinal sides of the finger lever. The outer levers 1*a*, 1*b* arranged parallel to each other on the two sides of the inner lever are exchangeable, structurally identical and configured axially symmetrical to their longitudinal axes 2. On their valve-side end regions, the outer levers 1*a*, 1*b* comprise two parallel spaced-apart tabs 3, 4 configured symmetrically to the longitudinal lever axis 2. On each of the tabs is arranged an aligned through-bore configured as a through-opening 5, 6 in which a cross-axle 12 traversing the inner lever at its valve-side end region is received. Each outer lever 1*a*, 1*b* is fixed on the cross-axle through a circlip 16 arranged between the tabs 3, 4 on the cross-axle 12. Alternatively, the axial fixing of the outer levers 1*a*, 1*b* can be effected, for instance, by riveting or caulking to the cross-axle 12. The valve support 11 is arranged on the underside of the valve-side end region of the inner lever. The cam-contacting surfaces on the upper sides of the outer levers 1*a*, 1*b* and the lateral overhang 10 arranged in the region of these on the longitudinal sides are configured symmetrically to the longitudinal lever axis 2. The contact sections 7 arranged on the longitudinal sides form, on each side, a symmetrical frontal contact for the pin on which the cam roller is mounted on the inner lever.

On the undersides of the support-side end regions of the outer levers 1*a*, 1*b* are arranged parallel, spaced-apart tabs 8, 9 extending symmetrically to the longitudinal lever axis 2. These tabs 8, 9 form respective, pocket-shaped depressions, symmetrical to the longitudinal lever axis 2, for articulation of the torsion leg springs arranged on the inner lever. The end section of the outer leg of the respective torsion leg spring engages positively into these depressions and bears at the same time against the underside of the outer levers 1*a*, 1*b* on support surfaces 17 configured symmetrically to the longitudinal lever axis 2 while bearing further against opposing inner longitudinal sides 18 of the tabs 8, 9 in cross-axle direction. The support surfaces 17 on the undersides of the tabs 8, 9 are configured in the form of an involute. The slightly upwards curved end section of the outer leg of the torsion leg spring can roll within the depression on these support surfaces 17 with low friction during a relative pivoting of the inner lever and outer levers 1*a*, 1*b*. The depression extends up to the support 14 for the locking pin 13 arranged on the inner lever, said depression being configured on the support-side end of the outer levers 1*a*, 1*b* on their undersides crosswise to the longitudinal lever axis 2 over the width of the lever.

Figure 3:
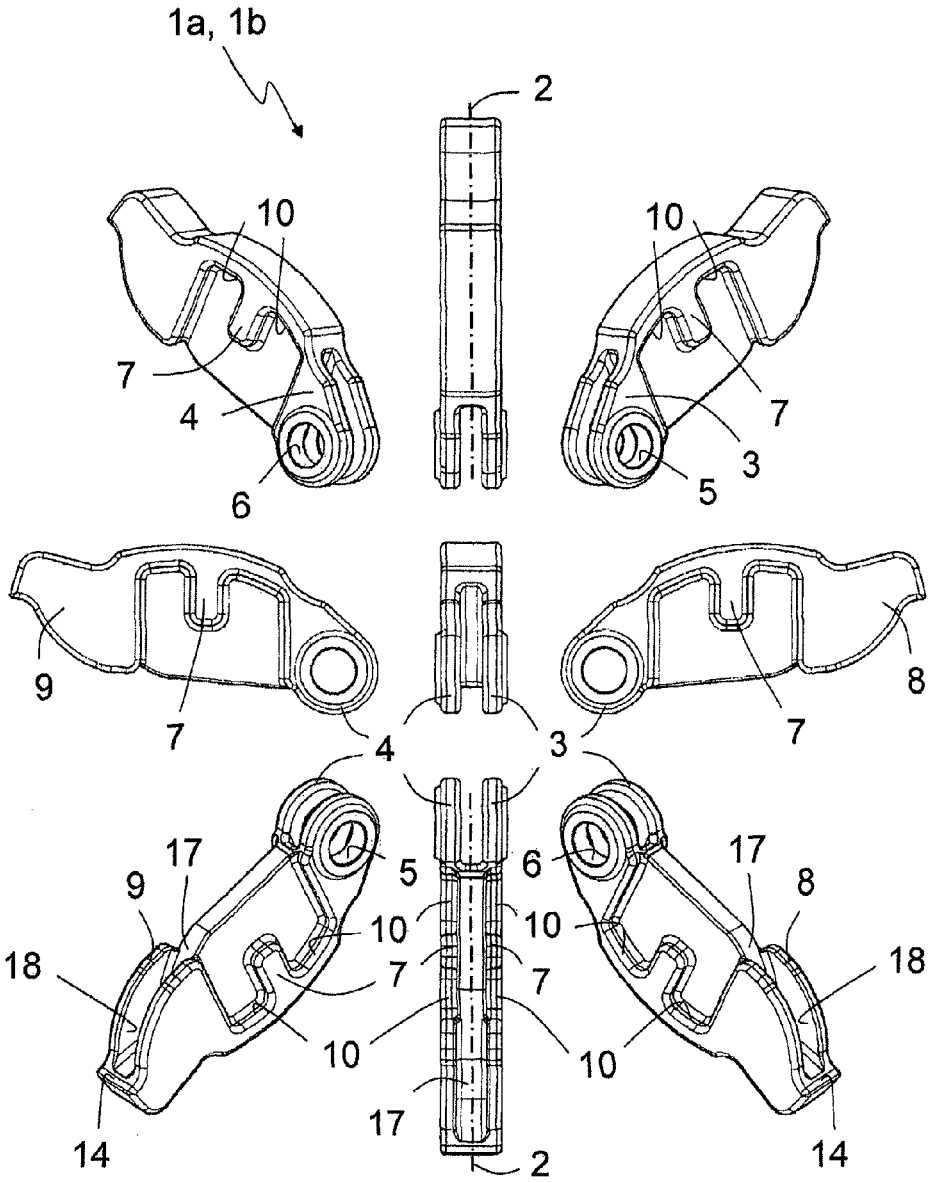
FIG. 3 is a compilation of a plurality of individual views of an outer lever of the finger lever.

FIG. 3 shows a plurality of individual views of the outer lever 1*a*, 1*b* according to the invention. The three upper and the three lower illustrations show a top view and two perspective views of the two longitudinal sides respectively of the upper side of the outer lever 1*a*, 1*b* facing the cam and of the underside of the outer lever 1*a*, 1*b* turned away from the cam. The three middle illustrations show the outer lever in two side views of the longitudinal sides and in a valve-side view.

The outer lever 1*a*, 1*b* comprises in the region of the cam-contacting surface on both sides of its upper side, a lateral overhang 10 configured on its longitudinal sides. Approximately at the center of its longitudinal sides between the longitudinal axial ends of the cam-contacting surface, the overhang 10 merges into lug-shaped contact sections 7 extending in direction of the underside for a frontal contact of the pin of the cam roller. The cam-contacting surface and the overhang 10, as also the contact sections 7 on the longitudinal sides, are configured perfectly symmetrically to the longitudinal lever axis 2. At the valve-side end region, the spaced-apart parallel tabs 3, 4 comprising the through-openings 5, 6 form a reception for the cross-axle for connection to the inner lever, said reception being configured perfectly symmetrically to the longitudinal lever axis 2. In the intermediate space formed between the tabs 3, 4, the outer lever 1*a*, 1*b* can be fixed in axial direction in a simple manner on the cross-axle 12. Between the tabs 8, 9 arranged parallel and spaced-apart on the support-side end region is formed on the underside, a pocket-shaped depression comprising a support surface 17 configured symmetrically to the longitudinal lever axis 2 and serving for the support of the outer legs of the torsion leg springs which are arranged on the inner lever. At the same time, the tabs 8, 9 enable a fixing of the outer legs of the torsion leg springs in cross-axle direction on opposing inner longitudinal sides 18. This leads to the realization of a perfectly symmetrical articulation of the torsion leg springs.

At the support-side end, the support surface 17 merges into the support 14 for the locking pin 13, which support 14 is arranged on the underside and configured symmetrically to the longitudinal lever axis 2 over the width of the lever.

List of References

1*a* Outer lever
1*b* Outer lever
2 Longitudinal lever axis
3 Tab
4 Tab
5 Through-opening
6 Through-opening

7 Contact section
8 Tab
9 Tab
10 Overhang
11 Valve support
12 Cross-axle
13 Locking pin
14 Support
15 Coil assembly
16 Circlip
17 Support surface
18 Longitudinal side

The invention claimed is:

1. A switchable finger lever for a valve train of an internal combustion engine, said finger lever comprising an inner lever which cooperates at a valve-side end region with a gas exchange valve of the internal combustion engine and is connected at a support-side end region facing away from the valve-side end region pivotally to a support, outer levers connected pivotally to the inner lever are arranged on both sides of the inner lever and are biased against the inner lever in a pivoting direction by a spring and are adapted to be coupled to the inner lever by a coupling element, the outer levers are configured with an identical structure and each of the outer levers is configured symmetrically to a longitudinal lever axis, wherein each of the outer levers comprises on the valve-side end region, two parallel spaced-apart tabs configured symmetrically to the longitudinal lever axis, said tabs comprising aligned through-openings extending crosswise to the longitudinal lever axis, and the outer levers being pivotally connected to the inner lever through a cross-axle connection in the through-openings.

2. A switchable finger lever according to claim 1, wherein the outer levers comprise on both longitudinal sides thereof, contact sections which are configured symmetrically to the longitudinal lever axis and serve for contact of a pin which is arranged crosswise to the longitudinal lever axis on the inner lever for rotary mounting of a cam roller which cooperates with a cam of a camshaft of the internal combustion engine, and said contact sections on the longitudinal sides facing the inner lever are situated frontally and pivotally opposite the pin.

3. A switchable finger lever according to claim 1, wherein the outer levers comprise on upper sides thereof facing the cams, cam-contacting surfaces adapted to cooperate with the cams and, in a region of the cam-contacting surfaces, the upper sides are configured with a lateral overhang that extends crosswise to the longitudinal lever axis and symmetrically to the longitudinal lever axis.

4. A switchable finger lever for a valve train of an internal combustion engine, said finger lever comprising an inner lever which cooperates at a valve-side end region with a gas exchange valve of the internal combustion engine and is connected at a support-side end region facing away from the valve-side end region pivotally to a support, outer levers connected pivotally to the inner lever are arranged on both sides of the inner lever and are biased against the inner lever in a pivoting direction by a spring and are adapted to be coupled to the inner lever by a coupling element, the outer levers are configured with an identical structure and each of the outer levers is configured symmetrically to a longitudinal lever axis, wherein two parallel spaced-apart tabs configured symmetrically to the longitudinal lever axis are arranged on the outer levers on the support-side end region of the outer levers on an underside facing away from the cam, said tabs forming a pocket-shaped depression which is open on the underside and towards a front end, and a leg of the spring, which comprises a torsion spring, connected to the inner lever engages positively into each of the depressions.

* * * * *